US005505376A

United States Patent [19]

Kent et al.

[11] Patent Number: 5,505,376

[45] Date of Patent: Apr. 9, 1996

[54] ENVELOPES

[76] Inventors: Cameron M. Kent, 5 Welch's Road, Wongawallan, Queensland 4210; Jeffrey A. Jones, 17 Moorfields Road, Fig Tree Pocket, Queensland 4069, both of Australia

[21] Appl. No.: 87,698

[22] PCT Filed: Jan. 9, 1992

[86] PCT No.: PCT/AU92/00009

§ 371 Date: Jul. 9, 1993

§ 102(e) Date: Jul. 9, 1993

[87] PCT Pub. No.: WO92/12064

PCT Pub. Date: Jul. 23, 1992

[30] Foreign Application Priority Data

| | | | |
|---|---|---|---|
| Jan. 9, 1991 | [AU] | Australia | PK4148 |
| Jan. 21, 1991 | [AU] | Australia | PK4275 |
| May 13, 1991 | [AU] | Australia | PK6107 |
| Sep. 13, 1991 | [AU] | Australia | PK8341 |

[51] Int. Cl.[6] ..... B65D 27/38

[52] U.S. Cl. ..... 229/311; 229/81

[58] Field of Search ..... 229/309, 310, 229/311, 312, 81; 383/206

[56] References Cited

U.S. PATENT DOCUMENTS

| | | | |
|---|---|---|---|
| 1,328,021 | 1/1920 | Ahana . | |
| 1,385,493 | 7/1921 | Putney | 229/310 |
| 2,923,457 | 2/1960 | Gerard | 383/206 |
| 3,104,048 | 9/1963 | Lemiesz | 229/311 |
| 3,243,099 | 3/1966 | Winegard | 383/206 |
| 3,653,585 | 4/1972 | Kazaros | 229/309 |
| 3,655,120 | 4/1972 | Stern | 229/310 |
| 4,795,035 | 1/1989 | Kim | 229/310 |

FOREIGN PATENT DOCUMENTS

| | | | |
|---|---|---|---|
| 3884 | 9/1926 | Australia . | |
| 10685 | 7/1947 | Australia . | |
| 652509 | 2/1928 | France | 229/81 |
| 2647563 | 4/1978 | Germany | 229/311 |
| 16784 | of 1893 | United Kingdom | 229/311 |
| 2101528 | 1/1983 | United Kingdom . | |
| 2160172 | 12/1985 | United Kingdom | 229/310 |
| 2179324 | 3/1987 | United Kingdom . | |

OTHER PUBLICATIONS

Dervent Publications Ltd. "Sealed Mailing Envelope"—DE–021989, Dec. 6, 1980.

*Primary Examiner*—Stephen P. Garbe
*Attorney, Agent, or Firm*—Helfgott & Karas

[57] ABSTRACT

A mailing envelope (10) has a stick down closure flap (11) extending from a fold line (12) along the top edge of a front panel (20). The closure flap (11) includes a graspable tear-out tab (19) to which is adhered a flexible line member (18) which extends across and is adhered to the envelope internally thereof. The envelope (10) may be opened by grasping the tab (19), with the line member adhered thereto, and pulling the tab (19) and the line member (18) away from the envelope to cause the line member (18) to tear through the envelope along the length of the line member. Preferably the line member (18) is secured to the flap (11) along it fold line (12).

7 Claims, 5 Drawing Sheets

ENVELOPES

FIELD OF THE INVENTION

This invention relates to envelopes and other tear open packages or containers and to opening means therefore.

DESCRIPTION OF THE PRIOR ART

Envelopes and in particular mailing envelopes and packages have common formats worldwide to facilitate automatic handling of mailed envelopes and for illustrative purposes only, particular reference will be made hereinafter to such containers. However it is to be understood that the application of this invention is not limited to mailing envelopes.

Typically, mailing envelopes include a fold-over enclosure flap which seals the envelope by adhering to the back face of the envelope. Such envelopes are normally opened by being torn open or cut open by inserting a paper knife into the envelope at the open corner portion at the junction of the closure flap with the front panel and subsequently cutting the flap from the front panel. Both these operations are associated with a likelihood that the mailed material inside the envelope will be damaged either by being cut with the paper knife or ripped during opening of the envelope. Furthermore information on the back face of the envelope such as the senders address and/or the post marked stamps on the front face of the envelope may also be damaged during normal opening operations.

Such damage can be a particular disadvantage where the receiver intends to store their mail in the envelope in which it was received or the information or post marked stamp is damaged.

Attempts have been made to provide easily opened envelopes such as is illustrated in International Publication NumberWP 85/03039. However it is considered that such envelopes would not be suitable for sorting by automatic sorters and may be difficult to use. Such removable strips, reinforced with metal foil or string and possibly defined between rows of perforations have also been used for larger postal containers which are not sorted automatically as are conventional envelopes. Automatic sorting imposes limitations on dimensions and format and makes extending tabs and strips unsuitable.

SUMMARY OF THE INVENTION

The present invention aims to alleviate at least one of the abovementioned disadvantages and to provide improved tear-open containers and to opening means therefore and a method of opening envelopes which will be reliable and efficient in use. Other objects and advantages of this invention will hereinafter become apparent.

With the foregoing and other objects in view, this invention in one aspect resides broadly in an envelope assembly having a stick-down closure flap which may be folded over and stuck to an adjacent envelope wall panel to seal the envelope, said envelope assembly including a graspable tab having a flexible line member secured thereto, said flexible line member extending from said graspable tab across and being secured to said envelope.

The flexible line member may be retained at or adjacent an edge of the container or in a wall thereof and if desired it may extend around three sides of the envelope. The flexible line member may be retained by adhesive applied over the flexible line member and the adjacent portion of the envelope or it may be coated with an adhesive adapted to adhere the flexible line member to the envelope, at a fold line if desired.

Preferably the envelope assembly is also provided with access means enabling access to be gained to the flexible line member whereby it may be readily grasped by a user and pulled away from the envelope assembly. The access means may provide access to an intermediate portion of the flexible line member but preferably the access means provides access to an end portion of the flexible line member and suitably an accessible end portion of the member is retained on a tear-off portion or graspable tab of the envelope assembly. Suitably the tear-off portion is external to the innermost front and back panels of the envelope assembly. The tear-off portion may extend adjacent or across an edge portion of the envelope assembly or it may be remote from an edge portion if desired. The tear-off portion may be a corner portion of the envelope or an edge portion of the closure flap spaced from its junction with the body of the envelope.

Suitably the tear-off portion is constituted by a peripheral portion of the closure flap adjacent the edge to be opened and which is defined by perforations extending towards the flexible line member. The perforations may terminate spaced from the flexible line member or they may continue past the flexible line member and across the opposed panel such that the perforations on opposed panels overlie one another and define a removable corner portion of the envelope assembly. In one form, the perforations extend for a short distance beyond the flexible line member across the adjacent panel. Alternatively the access means may include or consist of a portion of the flexible line member which protrudes beyond the envelope.

In a further form the perforations form a tear off portion which constitutes an end portion of the closure flap which may have press to seal or convention adhesive extending from the tear off portion towards the other end of the envelope.

The flexible line member is suitably of such form that when tensioned it is adapted to tear through the edge portion of the envelope to which it is adhered. The edge portion may be suitably weakened such as by being perforated if desired. In a preferred form the flexible line member is in the form of cotton or other suitable thread but of course it could be a mono-filament plastics line or film or the like. Alternatively the flexible line member could be in the form of a metal or plastics wire, or foil extending across the edge to be opened and having an enlarged end portion adhered or otherwise connected to a tear-off portion of the envelope.

Preferably the flexible line member is adhered to the internal surface of the envelope along or adjacent the junction line or a glue line. The adhesion for the flexible line member may be in the form of a continuous adhesion or it may be in the form of an intermittent adhesion, possibly associated with perforations and adhered between perforations. If desired the flexible line member may be adhered only to the tear-off tab at one end and at its other end to the envelope.

The tear-off portion of a closure flap may extend adjacent a further sealable part divided therefrom by the flexible line member and a tear-off portion may be adapted to close against a portion of the complementary face spaced in from the edge whereby the further sealable part may close against the complementary face intermediate the edge and the closed tear-off portion.

BRIEF DESCRIPTION OF THE DRAWINGS

In order that this invention may be more readily understood and put into practical effect, reference will now be made to the accompanying drawings which illustrates typical embodiments of the present invention and wherein.

DESCRIPTION OF THE PREFERRED EMBODIMENTS

Figure 1:
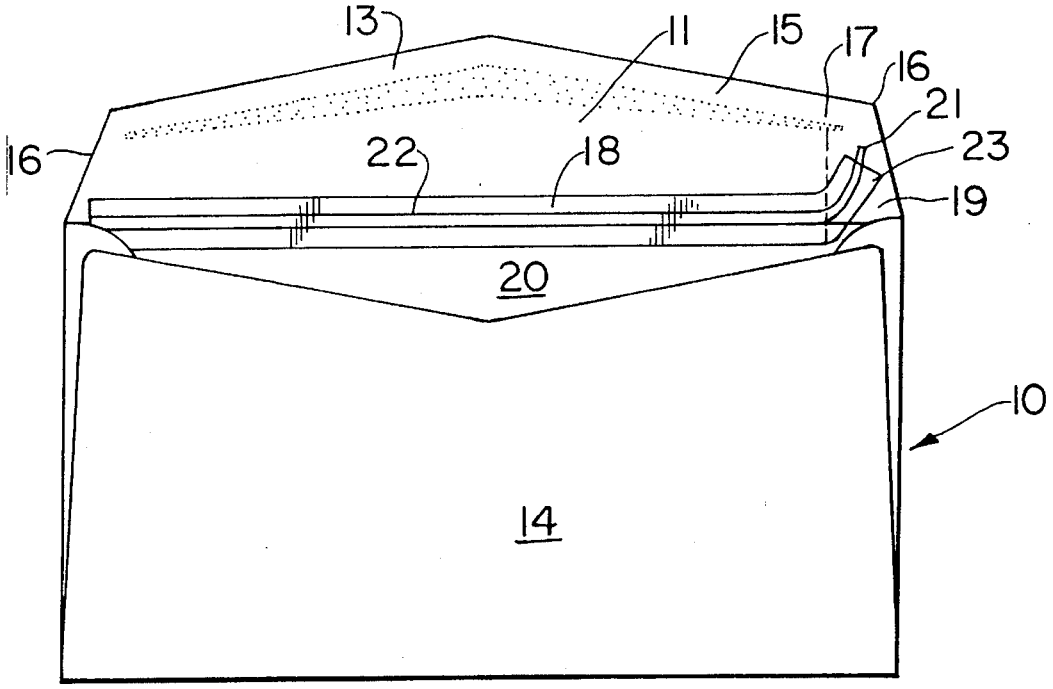
FIG. 1 is a back view of an open envelope.
Figure 2:
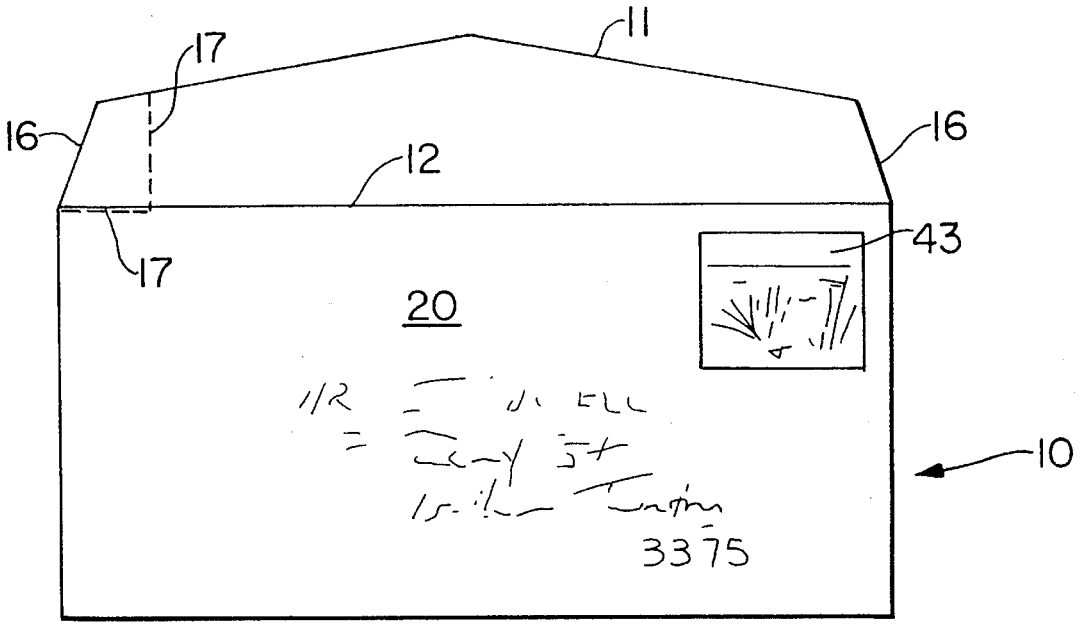
FIG. 2 is a front view of the open envelope.

The envelope 10 illustrated in FIGS. 1 and 2 is of conventional form and includes a closure flap 11 adapted to fold along the fold line 12 to seal the envelope by adhesion of its peripheral edge portion 13 to the back panel 14 of the envelope. For this purpose the peripheral edge portion is provided with a glue zone 15 which extends from side to side of the flap and which terminates inwardly of the opposed ends 16 of the peripheral edge portion 13 in conventional manner. One of the opposed ends 16 is provided with lines of perforations 17 which forms the end portion 19 of the flap into a tear-off tab which overlies the back panel 14 and which can be removed without requiring access to the contents disposed between the front and back panels 20 and 14 respectively.

A cotton thread 18 is adhered to the internal face of the envelope 10 along the fold line 12. The thread is adhered along the fold line 12 by a layer of adhesive 22. One end 21 of the thread 18 extends away from the fold line 12 to overlie the end portion 16 to which it is glued by adhesive 23 as illustrated. Of course the thread 18 could extend fully along the fold line and be retained on the end portion 16 by the glue line.

As the thread 18 is glued in position it will not be dislodged during insertion of mail into the envelope and it will be retained in position along the fold line 12 to ensure opening along that line. Furthermore it is considered that the glue strengthens the cotton thread and facilitates its effectiveness in cutting through the envelope material when it is pulled away from the envelope.

The thread may be glued by being placed in position prior to adhesive being applied over the thread and the envelope about the fold line 12 or alternatively the thread may be pre-glued and adapted to adhere to the edge portion during the envelope manufacturing process.

In use the envelope is sealed in conventional manner with the flap 11 being folded about the fold line 12 and over the contents for adhesion to the back panel 14. The envelope is opened by inserting a finger beneath the one portion, grasping same and lifting the tab portion 16 from the back wall and tearing it away from the remainder of the flap along the perforation line 17. The tab 16 is then pulled away from the envelope. This action will pull the thread progressively through the envelope along the fold line 12 until the flap 11 is severed from the front panel 20 to provide access to the interior of the envelope.

During this process no damage is caused to the envelope other than opening along the fold line 12 and removal of the side portion 16 of the closure flap 11, which portion is isolated from the contents by the underlying portion of the back panel 14. Thus the opening process will not damage the contents and the envelope will remain useful for securing its contents therein with all information on the back and front panels intact.

Figure 3:
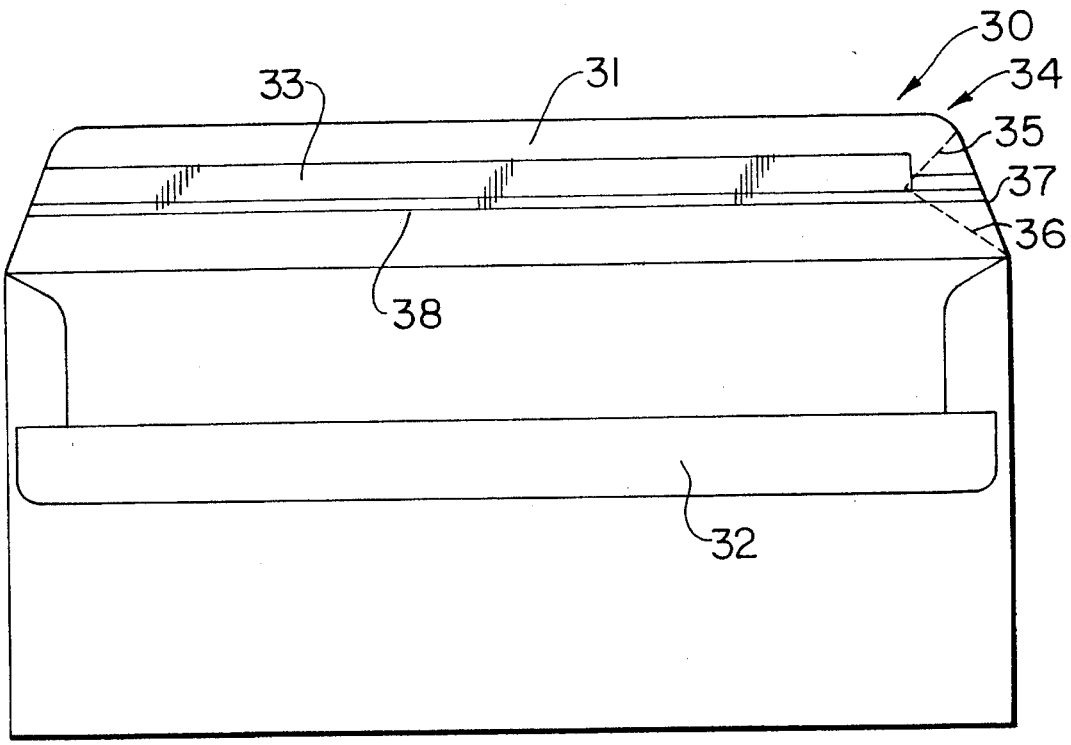
FIG. 3 is a rear view of an alternate form of envelope.
Figure 4:
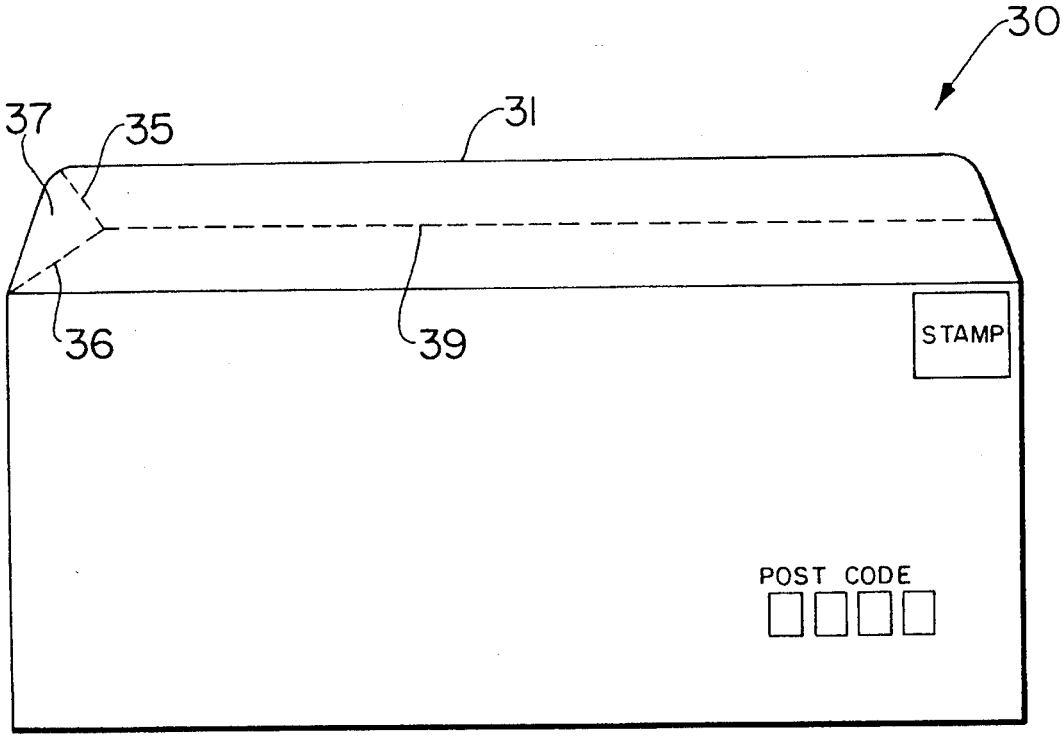
FIG. 4 is a front view of the envelope illustrated in FIG. 3.

The envelope 30 illustrated in FIGS. 3 and 4 has a closure flap 31 and a cooperating fold-up flap 32 adapted to adhere together in known manner when pressed together. A band of adhesive 33 terminates short of one end 34 of the flap 31 and lines of perforations 35 and 36 extend inwardly from that end to the base of the adhesive band 33 to form a triangular tab 37 not covered by the band 33 of adhesive. A flexible line member 38 extends across and is adhered to the flap 31 at or adjacent the base of the band 33 and across the tab 37 whereby the flexible line member 38 may be grasped and torn from the envelope, when sealed, to open the envelope. For this purpose the user's finger is placed under the tab 37 which can be readily pulled away from the flap along the lines of perforations 35 and 36 together with the end portion 40 of the flexible line member 38. The adhesive which holds the line member 38 does not adhesively engage the back of the envelope 30 when the envelope is sealed.

The flexible line member 38 is then accessible for opening purposes whereby the envelope may be opened along the extended line of perforations 39 by pulling the flexible line member 38 through the flap at the base of the adhesive band 33. If desired the flexible line member 38 may be adhered to the flap 31 by the adhesive band 33 at the time of application of the adhesive band to the envelope.

Figure 5:
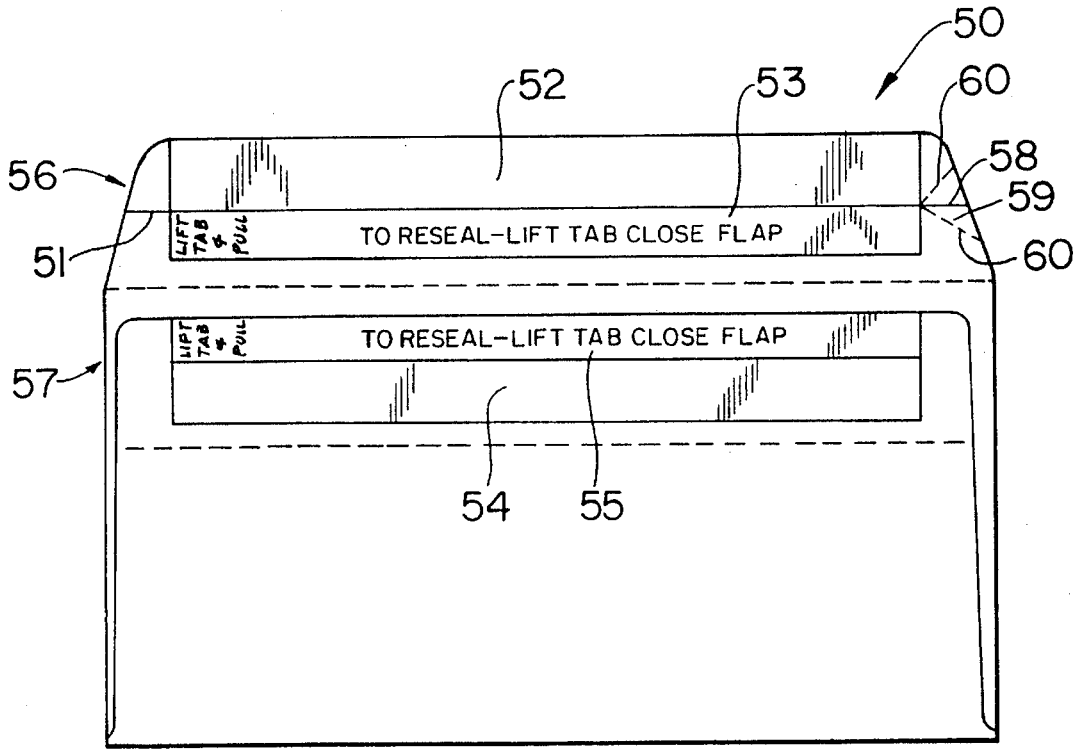
FIGS. 5 to 7 illustrate a re-usable embodiment of the invention.
Figure 6:
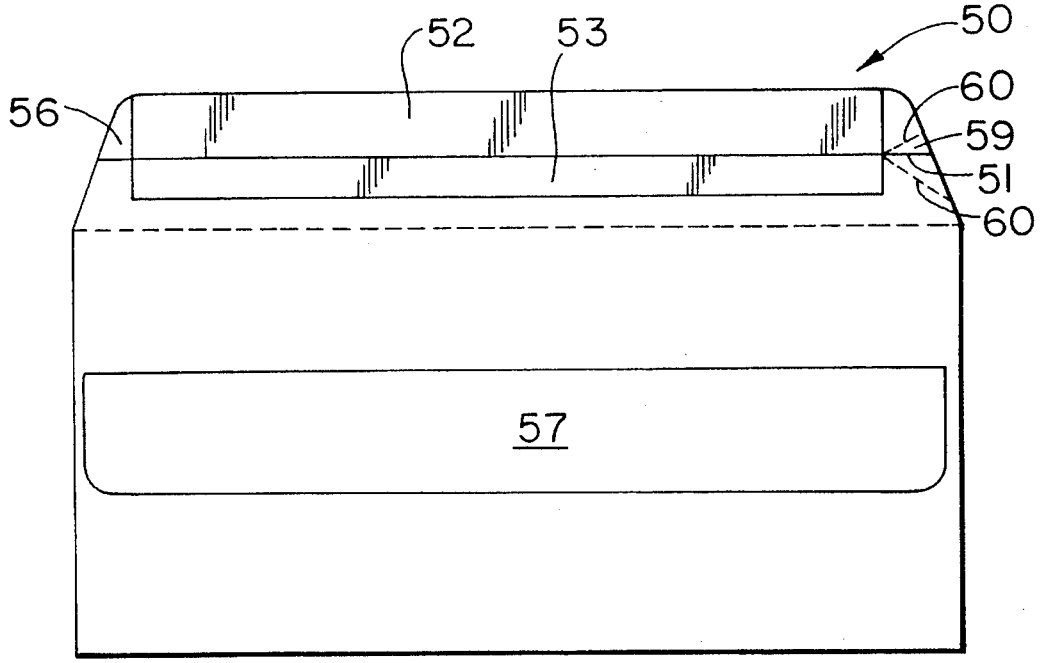
Figure 7:
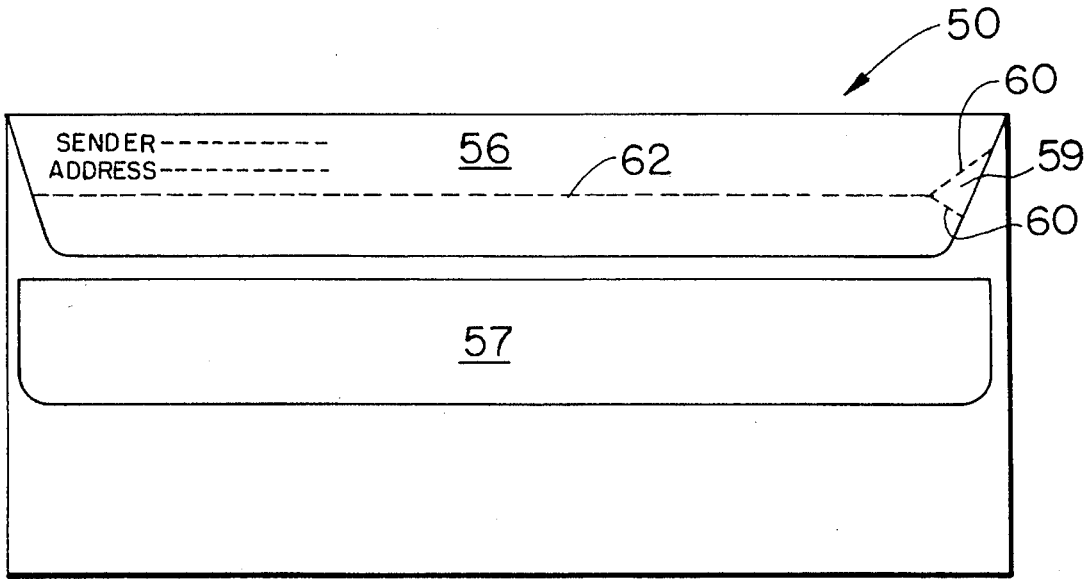

The envelope 50 illustrated in FIGS. 5 to 7 has the flexible line member 51 adhered along a junction line between adjoining adhesive zones 52 and 53 which may be selectively join with complementary contact zones 54 and 55 on the back flap 57 of the envelope 50. The adhesive zone 53 and the contact zone 55 are normally covered and are only uncovered to permit the flap 56 to be to be resealed after opening of the envelope by tearing the flap 56 along the junction line by use of the flexible line member 51. Alternatively for security purposes, where a sender requires that opening can not occur by accidental or other use of the flexible line member 51, both adhesive and contact zones may be utilized. As in the previous embodiments, the end 58 of the line member 51 is adhered to a removable finger tab 59, defined by converging rows of perforations 60, to facilitate opening of the envelope 50.

It will also be seen from FIG. 7 that when closed, the graspable tab 59 overlies the back wall 61 of the envelope 50. Thus the back wall protects the contents of the envelope from damage when a finger is insert beneath the tab 59 to tear open the envelope by tearing out the line member 51 along the weakening line 62.

Figure 8:
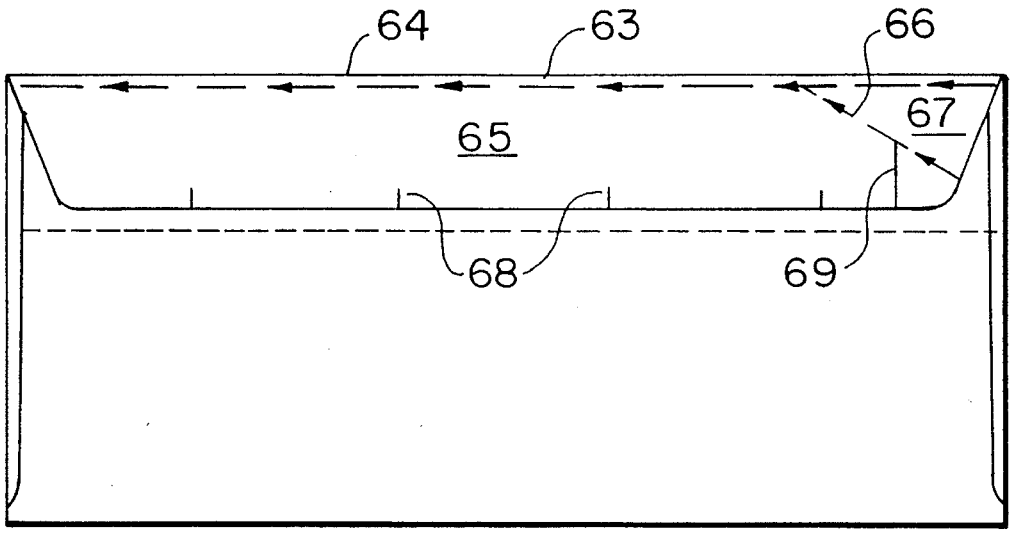
FIG. 8 is a rear view of a preferred form of envelope.

In a preferred embodiment of the invention as illustrated in FIG. 8 a line of perforations 63 extends fully across the upper edge 64 of the back flap 65 and arrows indicate the direction of tearing to open the envelope. The graspable tab 67 is formed between one end of the line of perforations 63 and a converging line of perforations 66. Conventional security slits 68 extend in from the lower edge of the flap 65. One slit 69 extends inwardly to intersect the perforation line 66.

This arrangement ensures that when a user's finger is pushed under the tab 67 it tears cleanly away from the back flap either along the line of perforations 63 and the perforation line 66 or failing that along the line 63, the slit 69 and the line 66. Furthermore opening is a single action, namely lift up the tab and continue to pull the thread, which is adhered to the tab 67 and to the envelope fully along the fold line 64, until the thread is ripped through the upper edge 64.

According to another aspect of this invention and in order to facilitate ease of installation of the tearing line or filament or the like flexible line member to an envelope blank, bag or package or other article such as continuous lengths of paper adapted to be divided into lengths, there is provided a filament, which may be a cotton or synthetic thread for example, which is first affixed, by adhering or otherwise securing as desired, to a tearable tape which in combination with the thread is adhered to an envelope.

The tape may be a self adhesive tape having adhesive at least on the side of the tape opposite the filament such that when the tape is adhered to an article such as an envelope or the like, the article can be opened by gaining access to the filament and then pulling the filament away from the article to pull it through the tape and the article to which it is adhered. The tape may include a tab portion as described below.

Figure 9:
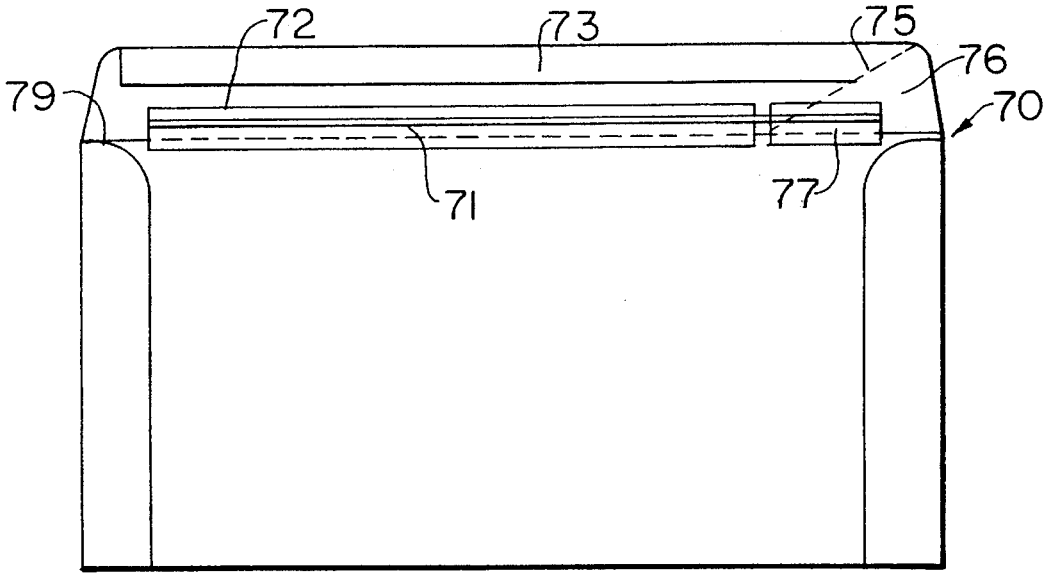
FIGS. 9 to 12 illustrate yet other embodiments of the invention.
Figure 10:
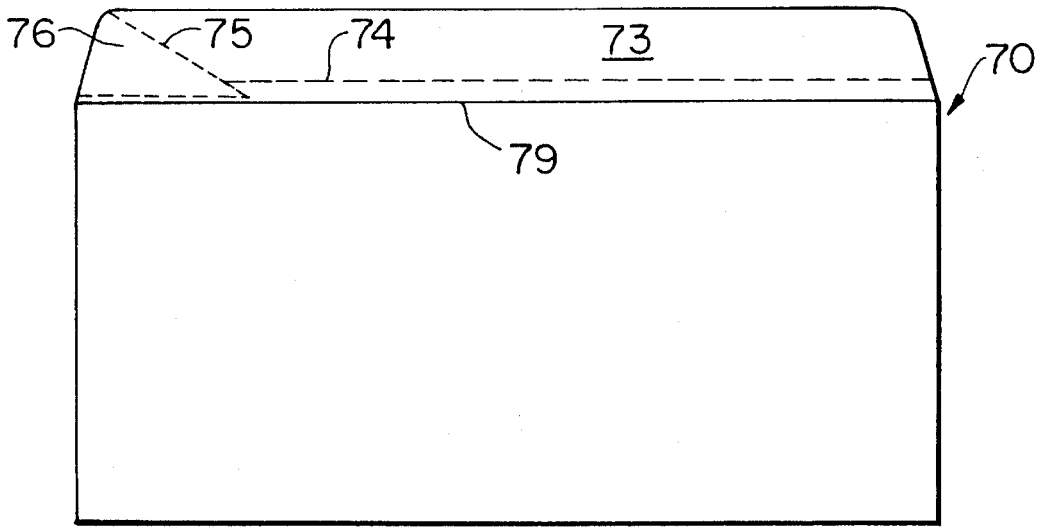
Figure 11:
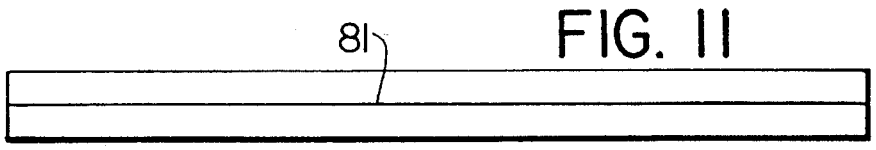

As shown in FIGS. 9 to 11, an envelope 70 utilizing this modification is provided with a tape 71, prepared with a cutting line member 72 as described above, secured over the fold line 79 for the sealing flap 73 with the thread 72 extending along the tape and internally of the envelope. The thread 72 is offset from the fold line and is disposed adjacent a line of perforations 74 extending across the flap 73. The latter is also perforated at one end along the line 75, as illustrated, to provide a finger tab 76 which may be gripped and withdrawn to cause the thread 72 to tear open the envelope along the line of perforations 74. The tape 71 includes a separate end part 77 which overlies the tab 76 and which comes away with the tab when the latter is removed to provide a finger grip for the line member 72. The opposite side of the envelope 70 is illustrated in FIG. 9.

Figure 12:
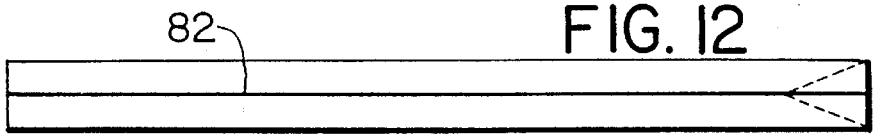

The tape according to this invention may be formed from a material which is readily torn and without a preformed tab as illustrated at 81 in FIG. 11 or with a tab formed by perforations 82 as illustrated in FIG. 12. The tape may be double sided tape if desired and may also be used as an envelope sealing medium.

It will of course be realized that the above has seen given only by way of illustrative example of the invention and that all such modifications and variations thereto as would be apparent to persons skilled in the art are deemed to fall within the broad scope and ambit of the invention as is defined in the appended claims.

What is claimed is:

1. An envelope assembly comprising:

an envelope having a stick-down closure flap connected at one edge to an adjacent envelope wall panel along a fold line, another edge of said flap being free, said flap being provided with a glue zone remote from the fold line along which said stick-down closure flap may be folded over and stuck to another adjacent envelope wall panel to seal the envelope;

a flexible line member extending across and being secured to said envelope along the fold line from which said stick-down closure flap extends and terminating within a periphery of said envelope;

a graspable tab integral with said stick-down closure flap and defined by converging lines of perforations formed in said stick-down closure flap at one end thereof, said graspable tab having said flexible line member secured thereto;

one of said lines of perforations extending along said fold line and the other of said lines of perforations extending from said free edge towards said fold line, and a slit extending from the free edge of said closure flap outside said tab and intersecting said other line of perforations.

2. An envelope assembly as claimed in claim 1, wherein said flexible line member is secured to said envelope along the length of said line member.

3. An envelope assembly as claimed in claim 1, wherein said stick-down closure flap is provided with security slits in said glue zone extending from the edge of the stick-down closure flap remote from its fold line.

4. An envelope assembly as claimed in claim 1, wherein said flexible line member is adhered to the internal surface of the envelope.

5. An envelope assembly as claimed in claim 1, wherein said envelope is provided with a weakening line extending substantially contiguous with said flexible line member.

6. An envelope assembly as claimed in claim 1, wherein said flexible line member is a cotton or other thread glued to said envelope.

7. An envelope assembly as claimed in claim 6, wherein said thread is glue impregnated.

* * * * *